United States Patent [19]

Maruyama et al.

[11] Patent Number: 5,001,516

[45] Date of Patent: Mar. 19, 1991

[54] PAGE PRINTER WITH ELECTRICALLY CONDUCTIVE LATERAL SIDE PLATE

[75] Inventors: Mitsuaki Maruyama; Hiroshi Niki; Shigeru Sawada; Seiji Mochizuki; Yasuhiro Gyoutoku, all of Nagano, Japan

[73] Assignee: Seiko Epson Corporation, Tokyo, Japan

[21] Appl. No.: 410,629

[22] Filed: Sep. 21, 1989

[30] Foreign Application Priority Data

Sep. 29, 1988 [JP] Japan ..... 63-246740

[51] Int. Cl.[5] ..... G03G 21/00

[52] U.S. Cl. ..... 355/202; 355/200; 358/296; 361/394

[58] Field of Search ..... 355/200, 210, 202; 346/160, 145; 361/212, 214, 391, 394, 415, 424; 358/296, 300, 301, 302; 174/35 R

[56] References Cited

U.S. PATENT DOCUMENTS 3,848,991 11/1974 Zeuthen ..... 355/200
4,618,137 10/1986 Boeve et al. .
4,664,504 5/1987 Oda et al. .
4,731,702 3/1988 Hiatt et al. ..... 361/391
4,752,801 6/1988 Kando .
4,754,293 6/1988 Aizawa et al. .

FOREIGN PATENT DOCUMENTS 0078019 5/1983 European Pat. Off. .
0240337 10/1987 European Pat. Off. .
60-37564 2/1985 Japan .
0181758 9/1985 Japan ..... 355/210
60-263958 12/1985 Japan .
62-127759 6/1987 Japan .

*Primary Examiner*—A. T. Grimley
*Assistant Examiner*—William J. Royer
*Attorney, Agent, or Firm*—Cushman, Darby & Cushman

[57] ABSTRACT

A page printer is provided which includes a housing having a lateral side plate that is formed from an electrically conductive material, with a gate roller, a developing unit, a photosensitive drum unit, a fixing unit and a paper discharging roller mounted in the housing. The electronic circuitry for controlling the page printer is disposed in a side portion of the housing with the lateral side plate disposed between the electronic circuitry and the units.

5 Claims, 8 Drawing Sheets

PAGE PRINTER WITH ELECTRICALLY CONDUCTIVE LATERAL SIDE PLATE

BACKGROUND OF THE INVENTION

1. Field of the Invention

The present invention relates to a page printer in which a light beam controlled in accordance with a data signal is radiated onto a photosensitive body so as to record characters and patterns on paper.

2. Description of the Related Art

In order to improve printing quality and printing speed, a page printer utilizing the principle of "xerography" has been developed in which a light beam is controlled in accordance with printing data so that a latent image is formed on a photosensitive drum, and colored toner is adhered to the latent image and then fixed on the paper being printed.

To facilitate maintenance and the like, such a page printer is typically made in a clamshell configuration. Thus, as shown in FIG. 10, the printer housing M is divided into two members N and Q so as to provide a large access opening. A light writing unit is housed in one half Q and a photosensitive drum, a developing unit, etc. are housed in the other half N. Further, a paper conveying path is provided from one side to the other side of the housing so that printing paper is fed from a paper cassette R provided on the one side of the housing. A substrate S of a controlling electronic circuit is housed in the housing N in its bottom portion so as not to hinder the formation of the light path.

With such a structure, when the circuit substrate has to be adjusted or otherwise maintained, it is necessary to invert the housing so as to expose the circuit substrate. Thus, it is impossible to operate the printer during adjustment of the circuit substrate.

SUMMARY OF THE INVENTION

The present invention was developed as a result of the foregoing disadvantage of the printer described above. Thus, it is an object of the invention to provide a page printer in which maintenance is easy.

The foregoing object is achieved according to the present invention, by providing a gate roller, a developing unit, a photosensitive drum unit, a fixing unit, and a paper discharging roller in a housing in the order stated from above, a light writing unit in the housing at its rear side, and a controlling electronic circuit means housed at the side portion of the housing.

Since the controlling electronic circuit means is independent of the printer mechanism, the controlling electronic circuit means can be adjusted even when the printer mechanism is being operated. Thus, adjustment is simplified.

Other objects, features, and characteristics of the present invention, as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENT

Figure 1:
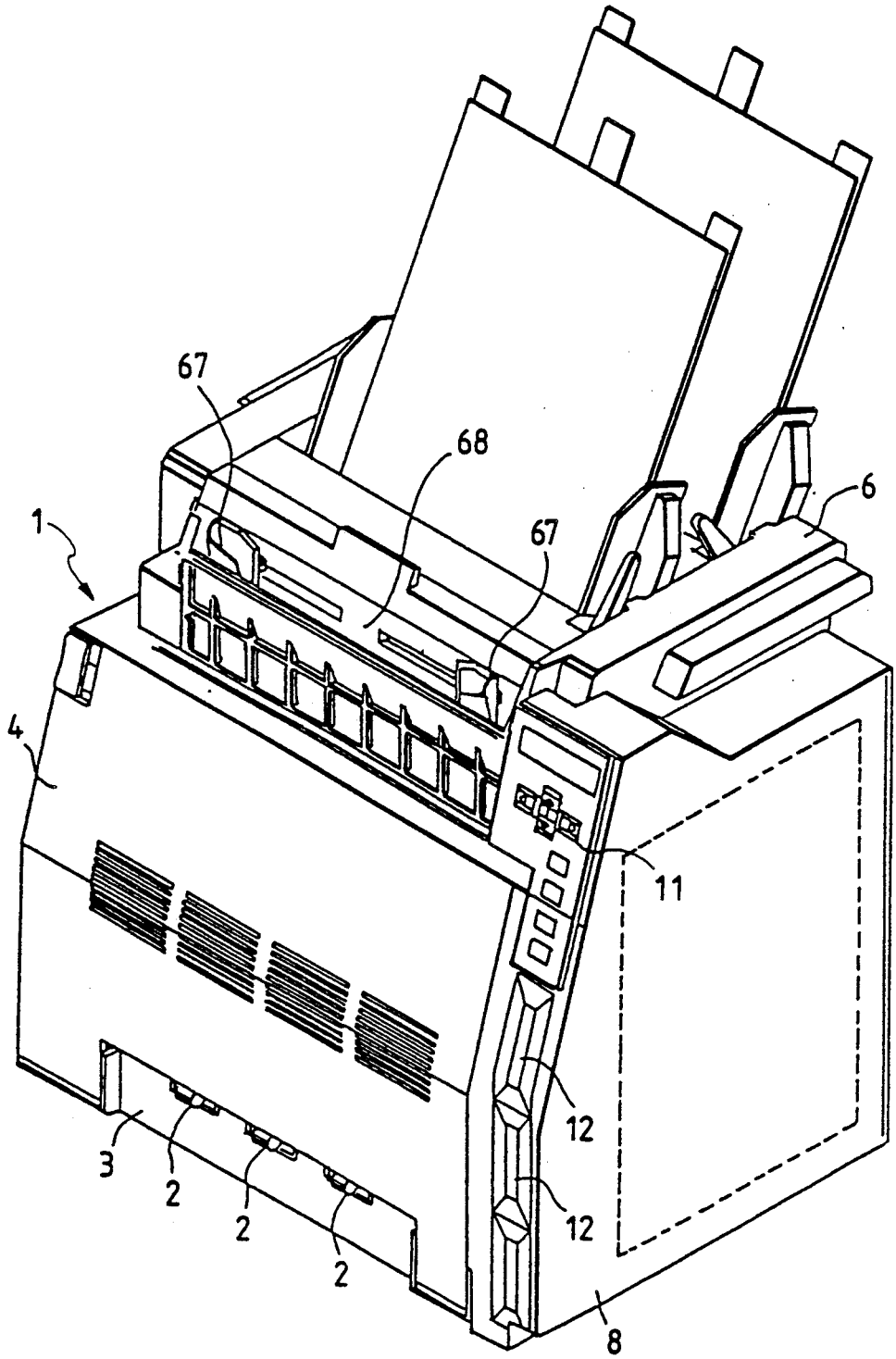
FIG. 1 is a perspective view showing the outside appearance of the printer of the invention on which a cut sheet feeder is mounted.
Figure 2:
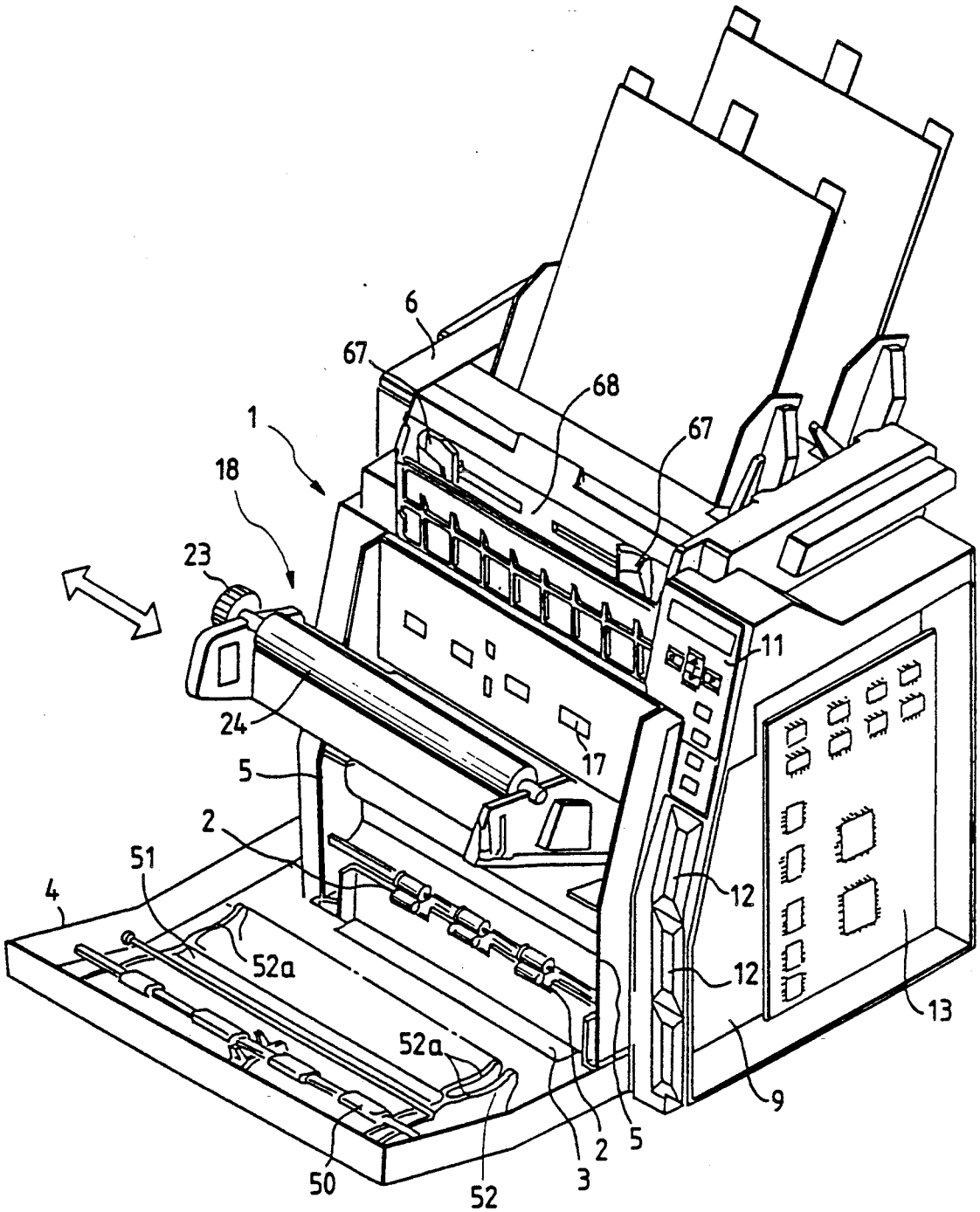
FIG. 2 is a perspective view showing the printer of FIG. 1 with the front cover opened and a photosensitive drum unit drawn out.
Figure 3:
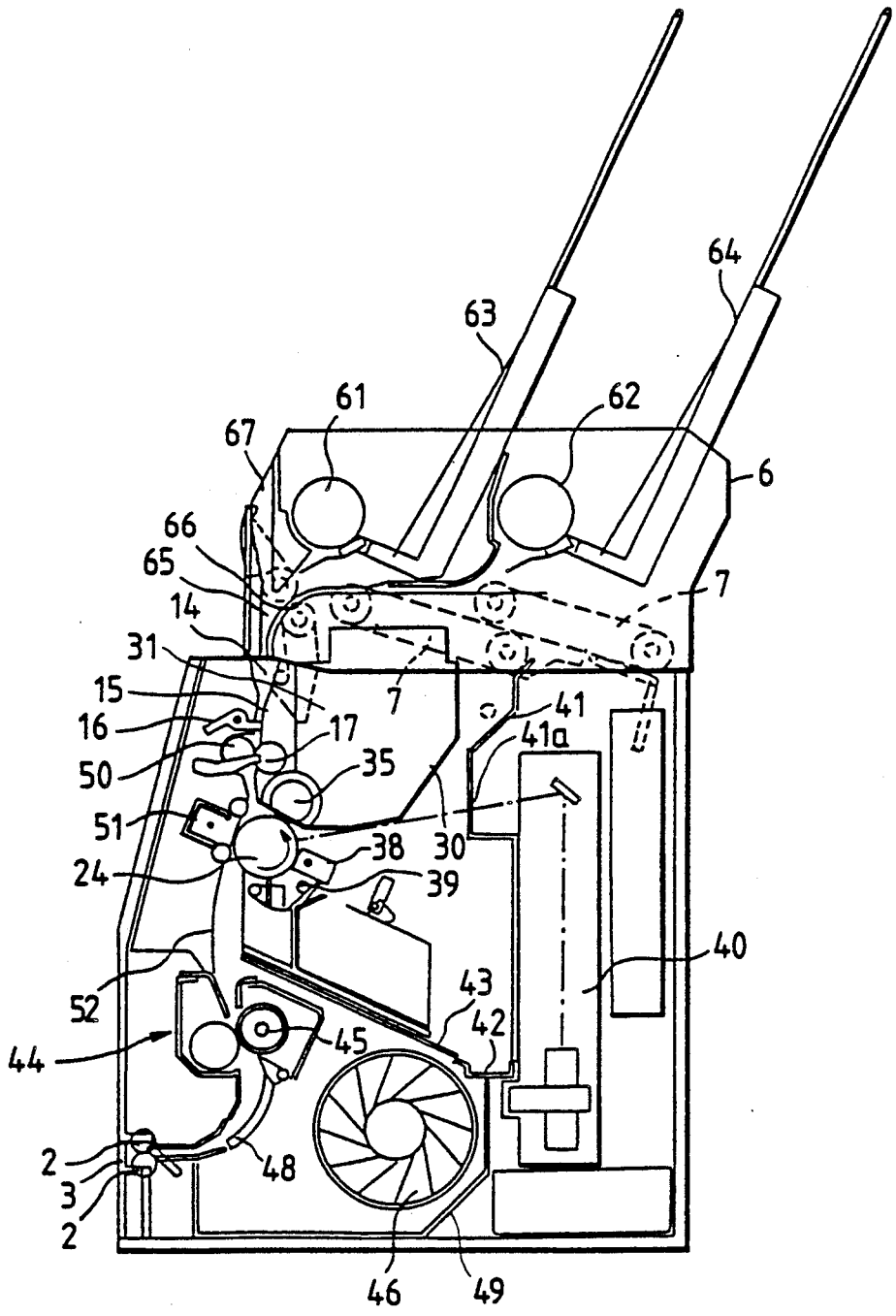
FIG. 3 is a sectional view showing the state in which printing can be performed.
Figure 4:
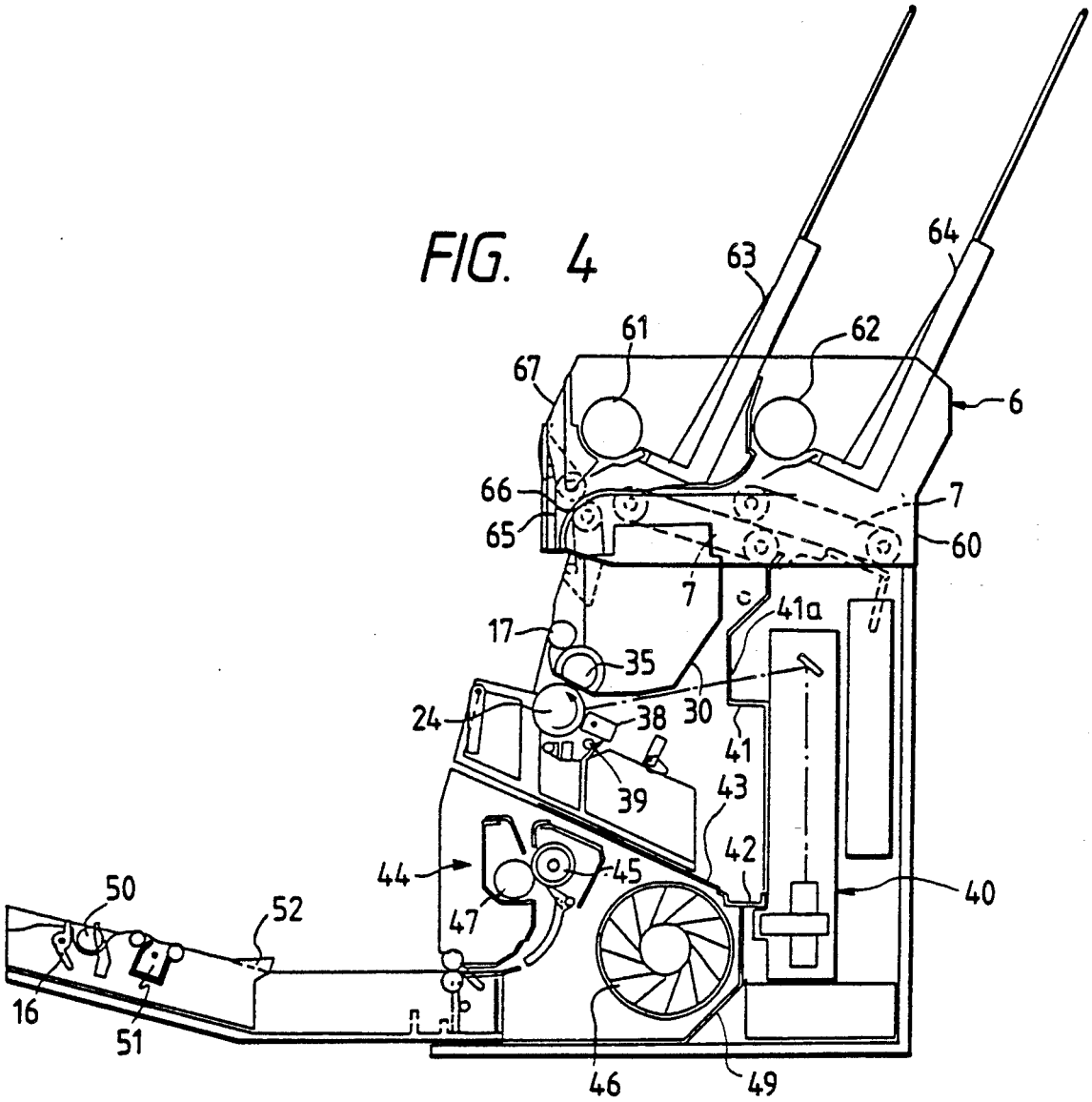
FIG. 4 is a sectional view showing the state in which the cover is opened.
Figure 10:
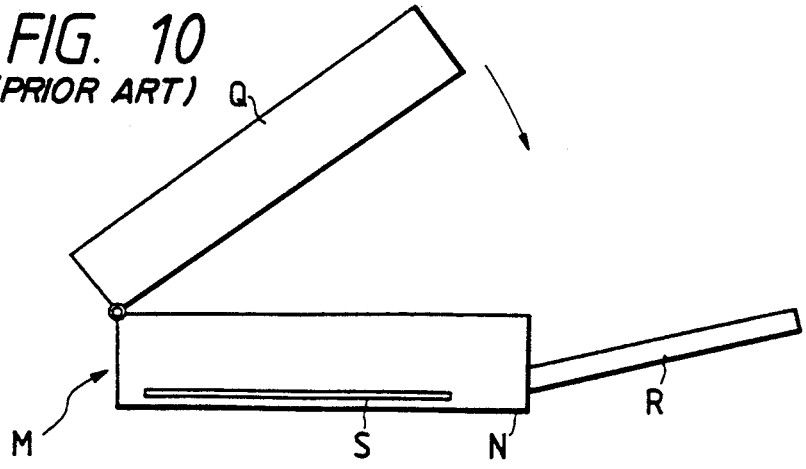
FIG. 10 (PRIOR ART)
FIG. 10 is a view showing an example of the conventional page printer.

The present invention will be described in detail hereunder on the basis of the illustrated embodiments.

FIGS. 1 through 4 are perspective and sectional views showing an embodiment of the present invention. In the drawings, the reference numeral 1 designates a housing for housing a printing mechanism. The housing 1 is provided with a paper discharge opening 3 for discharging printed paper fed from paper discharge rollers 2 at a lower portion of the housing on the front side of the housing. A cover body 4 is pivotally attached to the housing with a hinge so as to cover the front side of the printer. Side plates 5 for supporting various kinds of units are provided on the inner surface of the opposite sides of the housing, and a cut sheet feeder 6 movable by means of guide mechanisms 7 is provided at the upper portion of the housing. Further, a space 9 which can be covered with a cover 8 is formed on the side of the housing 1. In the embodiment illustrated in FIG. 6, space 9 is separated from the housing interior by means of the side plate 5 and a side wall 1*a* of the housing. A controlling electronic circuit substrate 13 is housed in space 9. A control panel 11 including operation switches and the like and external storage medium insertion openings 12 are provided on the front surface of the housing 1.

Figure 5:
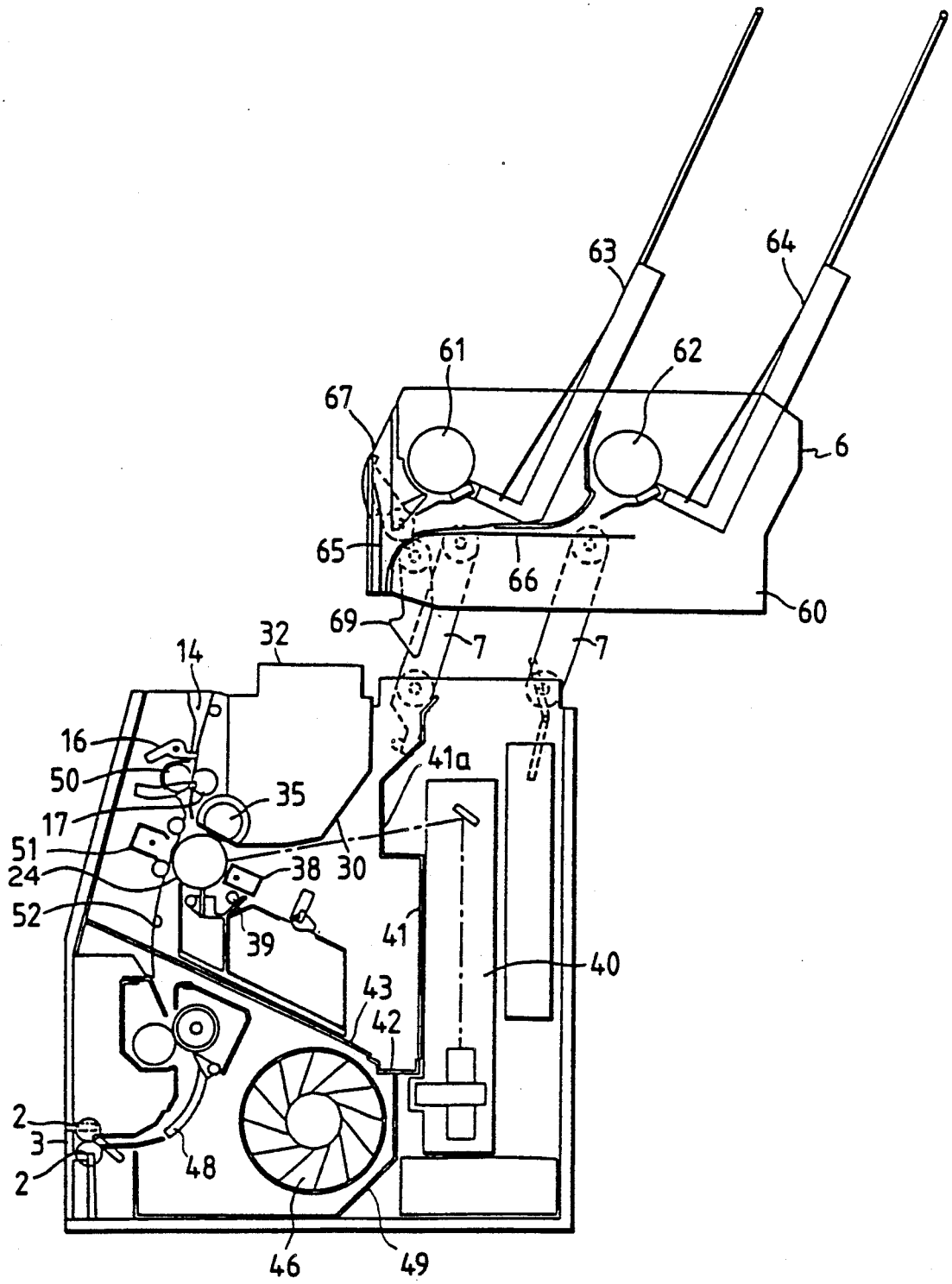
FIG. 5 is a sectional view showing the state in which the cut sheet feeder is retreated.

A paper guide plate 15 defining a paper receiver 14 which is opened at its upper end, a gate roller 17, a photosensitive drum unit 18, and a fixing unit 18 provided below a shielding plate 43 are mounted, in that order, to the front side of the housing. A developing unit 30 is provided on the rear side of the paper guide plate 15 and has a shutter 32 provided so that a toner supply opening is exposed when the cut sheet feeder 6 is retreated (FIG. 5).

A magnetic brush on the surface of a magnetic sleeve 35 of the developing unit 30 is in contact with the circumference of the photosensitive drum 24. An electrostatic charger unit 38 is provided with a predetermined gap circumferentially from the bottom of the developing unit 30, and a discharger unit 39 is provided on the upstream side in the rotation direction of the electrostatic charger unit 38.

The housing interior is separated by a partition wall 41 into front and rear spaces. An optical writing unit 40 is provided in the rear space so that a light beam from the optical writing unit 40 is radiated onto a surface of the photosensitive drum 24 through a window 41*a* of the partition wall 41 and through the gap between the developing unit 30 and the electrostatic charger unit 38.

The housing is divided into upper and lower spaces by the shielding plate 43 below the photosensitive drum unit 18. The fixing unit 44, constituted by a heating roller 45 and a pressing roller 47, and an exhaust fan 46 are provided in the lower space. A groove 42 for receiving waste toner is provided at the joint of the plate 43 and the wall 41.

A paper guide 48 is provided on the discharge side of the fixing unit 44 so as to form a path for transporting vertically moved printing paper to the paper discharge opening 3 through the paper discharge rollers.

A paper detecting lever 16 for operating a paper detector (not shown), a pinch roller 50 which abuts the gate roller 17, and a transfer unit 51 opposed to the photosensitive drum 24 on the downstream side of the magnetic sleeve 35 are provided on the inner surface of the cover 4. A guide member 52 defined by a plurality of centrally-concave ribs 52*a* arranged in the direction of width of the paper is provided on the path extending from the photosensitive drum 24 to the fixing unit 44 so that the paper discharged from the photosensitive drum 24 is convexly curved on the cover 4 side.

The cut sheet feeder 6 includes a base 60 which can be set in two positions: a paper feeding position (FIG. 3) and a retreating position (FIG. 5). A plurality of paper feeding rollers 61 and 62 are provided on the base 60 so as to be parallel to each other at front and rear positions relative to the front side. Paper hoppers 63 and 64 are erected on the base 60 so as to make the lower end of the paper to be printed touch the feeding rollers 61 and 62. Guide members 65 and 66 extend from the lower ends of the paper feeding rollers 61 and 62 to the paper receiving opening 14. Further, laterally movable guide members 67 are attached substantially vertically above the paper receiving opening 14 to thereby form a hand insertion inlet 68. Finally, a lock member 69 is preferably provided for fixing the base 60 to the body 1.

When the size of paper to be printed is selected, one of the paper feeding rollers 61 and 62, which corresponds to the selected size, for example, the paper feeding roller 62, is rotated and a sheet of paper is taken out from the paper hopper 64 and moved toward the body 1 by the guide 66. When the top end of the paper reaches the upper surface of the housing body 1, the paper enters the upwardly open receiving opening 14 and is guided by the guide plate 15 so as to move downwardly in the body 1 to abut the gate roller 17. At this stage, the paper activates the paper detecting lever 16. Accordingly, a signal is produced by the paper and the gate roller 17 is rotated to further move the paper downward after detecting a reference position of the paper.

On the other hand, data to be printed is supplied to the controlling circuit substrate 13 so that the light beam generating unit 40 is controlled to form a latent image on the photosensitive drum 24 in accordance with the supplied data. Toner is adhered to the latent image by the developing sleeve 35 with the rotation of the photosensitive drum 24 so as to develop the latent image. The developed image is moved to a position opposed to the transfer unit 51 as the photosensitive drum 24 rotates, for example by rotating knob 23, is transferred onto the printing paper.

The printing paper passed through the transfer unit 51 touches the top end of guide member 52 of the cover 4 and moves downwardly with its rear surface moving along the guide member 52 as the page is printed. Thus, while being kept in a bent or curved state, the paper is fed into the fixing unit 44, where the toner adhering on the paper surface is fixed. Thus, the printing paper is moved to the fixing unit 44 so that a gap is maintained between the housing body and the surface of the paper which has non-fixed toner thereon. That is, the printing paper is moved to the fixing unit 44 and the toner is fixed thereon without the toner adhering on the surface of the paper being rubbed by the housing body.

The paper passed through the fixing unit 44 is guided by the guide member 48 so as to be discharged by the paper discharge rollers 2 from the paper discharge opening 3 with the printed surface of the paper facing down. During the fixing step, high temperature air due to exhaust heat of the fixing unit and moisture evaporated from the printing paper are prevented from penetrating into the photosensitive drum 24 and the optical writing unit 40 by the shielding plate 43 and a second partition 49 and are immediately discharged from the housing by the fan 46.

If paper is jammed during printing, the cover 4 is opened and the paper pressing members such as the pinch roller 50, the transfer unit 51, the paper guide member 52, etc. are separated from the body 1 together with the cover 4. Thus, the printing paper conveying path is exposed on the front of the apparatus and the jammed paper can be easily removed.

After the paper has been completely removed, the cover 4 is gently returned to the body 1 so as to enable printing to be continued. During the opening and closing of the cover, of course, the optical writing unit 40 and the photosensitive drum 24 are stationary on the side of the body 1. Thus, there is no relative displacement between the optical writing unit 40 and the photosensitive drum 24 which require precise positioning, and consequently no problems associated therewith.

Although static electricity having an extremely high electric potential is generated during the printing process because printing paper is frictionally passed on the photosensitive drum 24 and the fixing roller 45, the printing mechanism and the controlling electronic circuit substrate 13 of the invention are separated from each other with side plate 5. Side plate 5 if formed from an electrically conductive material and thus serves as a shield against static electricity. In addition, noise is prevented from entering the controlling electronic circuit substrate 13 without any special additional shielding structures.

If it is necessary to adjust the controlling electronic circuit substrate 13 upon completion of assembly of the apparatus or for maintenance of the apparatus, the cover 8 provided on the side of the housing 1 can be opened, and the circuit substrate 13 can be exposed with out moving the housing or otherwise disrupting or preventing printing. Accordingly, depending on the items to be adjusted, the controlling electronic circuit substrate 13 can be adjusted while printing is being performed.

Figure 6:
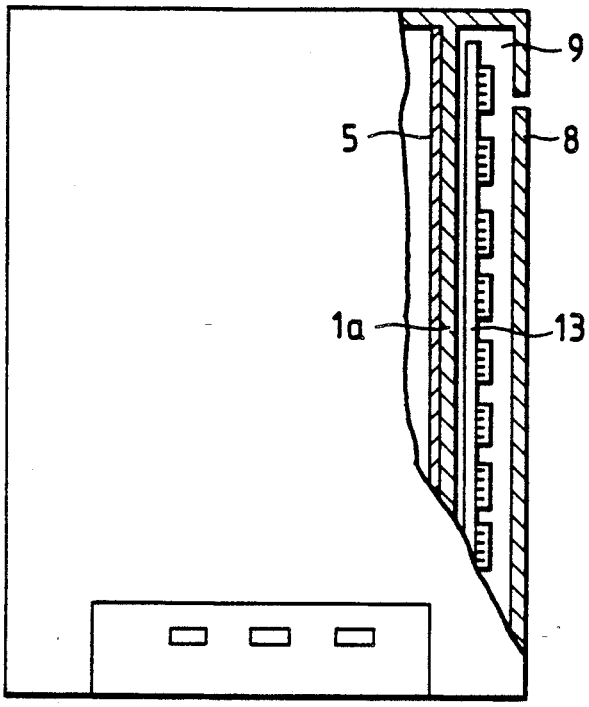
FIG. 6 is a sectional view showing the sectional structure in the vicinity of the circuit substrate housing portion.
Figure 7:
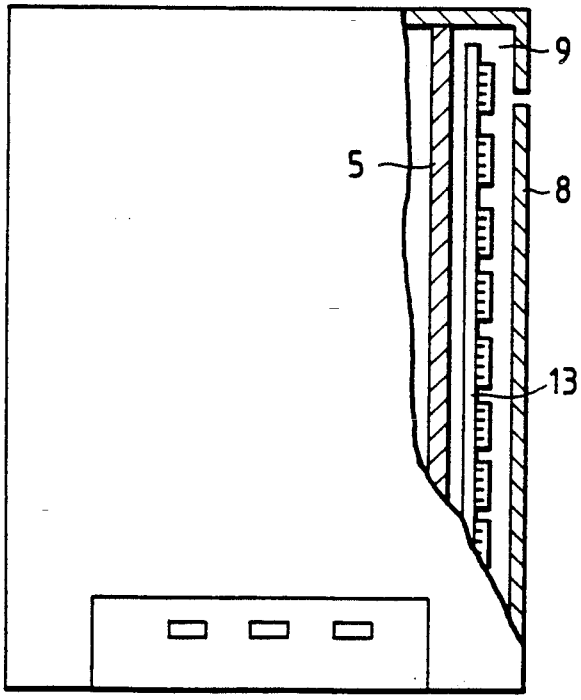
FIG. 7 is a sectional view showing another embodiment of the present invention.

Although the space 9 is defined adjacent or in side wall 1*a* of the housing in the embodiment of FIG. 6, it is apparent that even if the space is separated from the housing interior by only a side plate 5, as shown in FIG. 7, the advantages of mounting the circuit substrate 13 to the side of the housing can still be realized.

Figure 8:
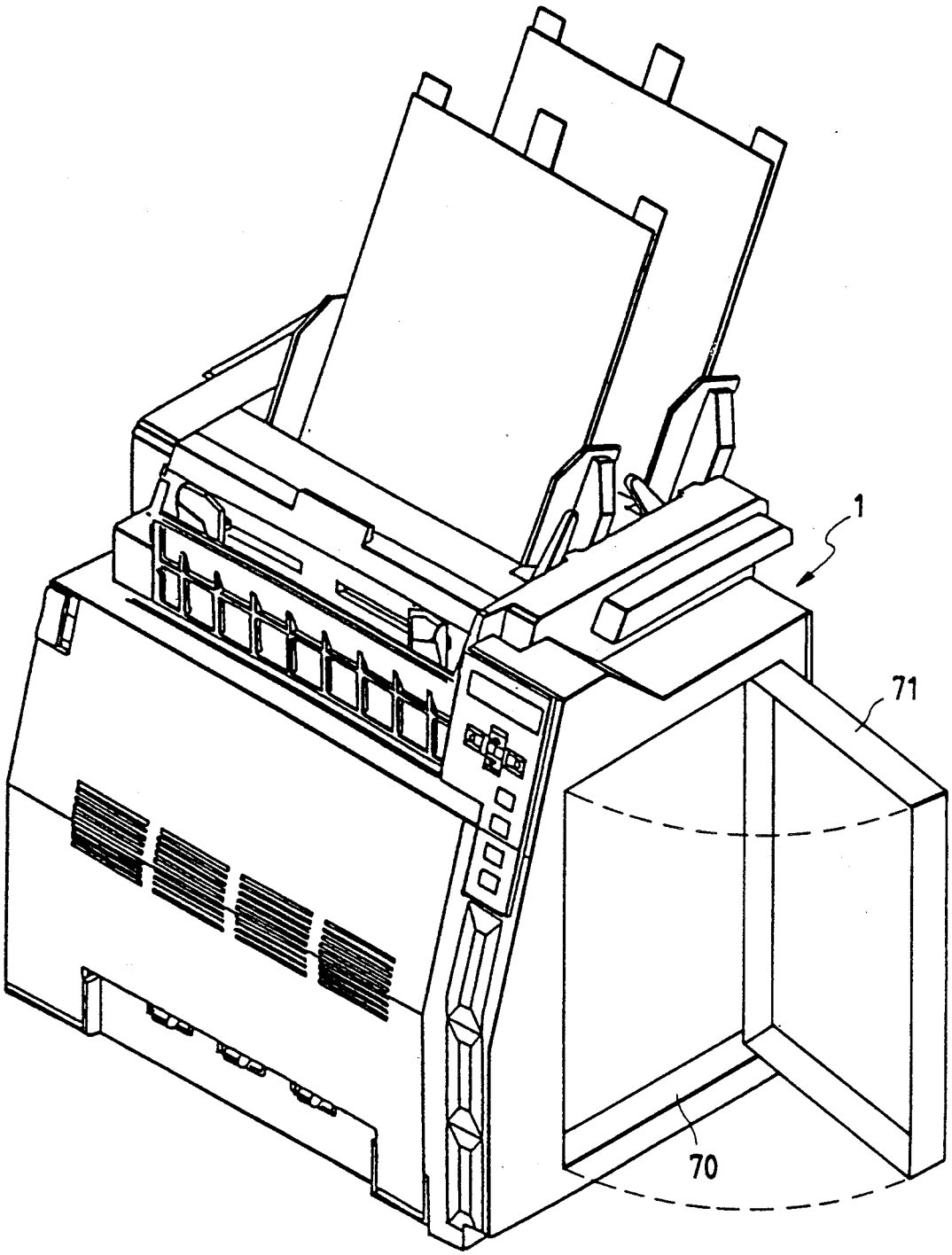
FIG. 8 is a perspective views showing a further embodiment of the present invention.

FIG. 8 shows a second embodiment of the present invention. In that figure, the reference numeral 70 designates a concave portion formed in the side portion of the housing. A pivotable boxlike cover body 71 is attached with a hinge to the end or edge of the concave portion 70 so as to house the controlling circuit substrate in the concave portion 70 or inside the cover body 71. In this embodiment, the circuit substrate can be housed in the concave portion 70 and the box-like cover body 71, so that the entire circuit substrate can be exposed by simply opening the cover body 71.

Figure 9:
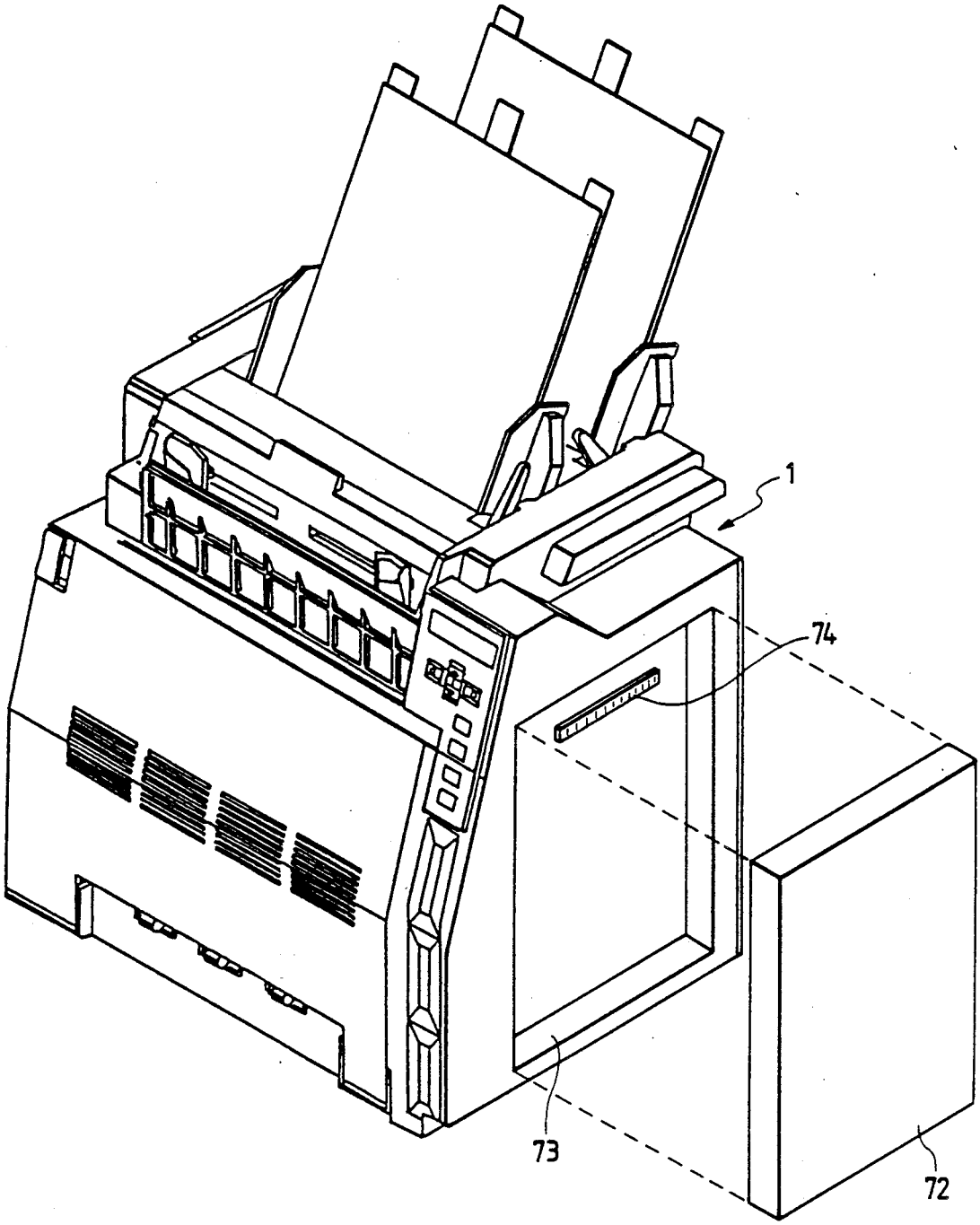
FIG. 9 is a perspective view showing yet a further embodiment of the invention.

FIG. 9 shows a third embodiment of the present invention. In that figure, the reference numeral 72 designates a box-like element for housing an electronic control circuit substrate. The boxlike element 72 can be inserted into a concave portion 73 formed in the housing body 1 and connected to the body with a connector 74. In this embodiment, by preparing a plurality of control circuits in advance for every user's specifications, the apparatus can be set in accordance with a required specification by simply exchanging the boxlike element 72.

As described above, according to the present invention, the gate roller, the developing unit, the photosensitive drum unit, the fixing unit, and the paper discharge rollers are assembled on the side plate of the housing in that order from above, and the controlling electronic circuit means is housed at the side portion of the housing so that the printing mechanism and the electronic control circuit portion are separated from each other. Accordingly, the circuit portion can be adjusted while the printing mechanism is being operated.

Further, according to the present invention, since the side plate is made of an electrically conductive material, static electricity due to the printing mechanism can be shielded by means of the side plate without a special shielding plate being required.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

We claim:

1. A page printer comprising:

a housing having a front side, a rear side, first and second lateral sides and at least one lateral side plate;

a gate roller, a developing unit, a photosensitive drum unit, a fixing unit, and a paper discharging roller mounted in the front side of the housing, and controlling electronic circuit means housed in said housing at a lateral side portion thereof, said lateral side plate being disposed between said circuit means and said units.

2. A page printer as in claim 1, wherein said lateral side plate is formed from an electrically conductive material.

3. A page printer as in claim 2, further comprising a box-like element removably attached to said housing at said lateral side portion thereof, said electronic circuit means being disposed in said box-like element.

4. A page printer comprising:

a housing having a front side, a rear side, first and second lateral sides and at least one lateral side plate;

a gate roller, a developing unit, a photosensitive drum unit, a fixing unit, and paper discharging roller which are mounted in the housing along a paper path through said housing, and controlling electronic circuit means housed in said housing at a lateral side portion thereof, said lateral side plate being disposed between said circuit means and said units.

5. A page printer as in claim 4, wherein said gate roller, said developing unit, said photosensitive drum unit, said fixing unit and said paper discharging roller mounted in the front side of the housing substantially vertically.

* * * * *